US006409640B2

(12) United States Patent
Cournoyer

(10) Patent No.: US 6,409,640 B2
(45) Date of Patent: Jun. 25, 2002

(54) UPPER BODY EXERCISE DEVICE

(76) Inventor: Yvan Cournoyer, 104, boul. des Châteaux, Blainville (Quebec) (CA), J7B 1K6

( * ) Notice: Subject to any disclaimer, the term of this patent is extended or adjusted under 35 U.S.C. 154(b) by 0 days.

(21) Appl. No.: 09/776,726

(22) Filed: Feb. 6, 2001

Related U.S. Application Data

(63) Continuation-in-part of application No. 09/370,181, filed on Aug. 9, 1999.

(51) Int. Cl.[7] ..... A63B 26/00
(52) U.S. Cl. ..... 482/141; 482/142; 482/148
(58) Field of Search ..... 482/140, 141, 482/142, 17, 38–39, 41–42, 104, 904, 148; D21/678; 182/194, 200, 206, 108, 228.1

(56) References Cited

U.S. PATENT DOCUMENTS

| | | | | | |
|---|---|---|---|---|---|
| 230,459 | A | | 7/1880 | Baker | |
| 907,402 | A | | 12/1908 | Prouty | |
| 1,104,505 | A | * | 7/1914 | Holworthy | |
| 3,642,278 | A | * | 2/1972 | Hinckley | 272/62 |
| 3,920,240 | A | * | 11/1975 | Rossq | 272/57 R |
| 4,231,448 | A | | 11/1980 | Jensen | |
| 4,371,055 | A | | 2/1983 | Ashton et al. | |
| 4,441,710 | A | | 4/1984 | Lay | |
| 4,772,011 | A | | 9/1988 | Guridi | |
| 4,923,194 | A | * | 5/1990 | Montgomery | 272/93 |
| 4,927,135 | A | | 5/1990 | Nieppola | |
| 4,973,051 | A | | 11/1990 | Stater | |
| 5,290,209 | A | | 3/1994 | Wilkinson | |
| 5,472,400 | A | | 12/1995 | Royer | |
| 5,527,242 | A | | 6/1996 | Gangloff | |
| 5,536,222 | A | * | 7/1996 | Banda et al. | 482/38 |
| 5,582,565 | A | * | 12/1996 | Soria | 482/141 |
| 5,989,158 | A | * | 11/1999 | Fredette | 482/38 |

* cited by examiner

*Primary Examiner*—Justine R. Yu
(74) *Attorney, Agent, or Firm*—François Martineau

(57) ABSTRACT

The exerciser has a pair of arcuate posts having lower footrests for resting on the ground, and a U-shape spacer bar, mounted to the top ends of the arcuate posts for free abutting against an upright wall. The two posts therefore remain substantially parallel to each other and to the upright wall. The posts are provided with notches distributed along their length, in a horizontally registering pair of which a push-up bar may be inserted for support of the push-up bar at a selected height over ground. The exerciser takes minimal ground space, yet allows may different types of exercises to be performed by an individual.

6 Claims, 21 Drawing Sheets

UPPER BODY EXERCISE DEVICE

CROSS REFERENCE DATA

This is a Continuation-In-Part application of co-pending parent U.S. patent application Ser. No. 09/370,181 filed Aug. 9, 1999.

FIELD OF THE INVENTION

The present invention relates to exercisers, and more particularly to an indoor exerciser for allowing a person to perform push-ups, sit ups, dips, chin-ups, stretching, and the like exercises.

BACKGROUND OF THE INVENTION

It is recognized in the medical profession that regular physical exercise followed by an individual does significantly reduce the likelihood that this individual will suffer from a number of physical diseases, in particular life-threatening cardiovascular medical conditions. It is not always possible or practical to perform these physical exercises outside of an individual residence, in view of climatic conditions: sub-freezing temperatures, snow, ice, rain, etc. . . . Other reasons for not going out to exercise may include fear of assault on the street in high crime areas—as is the case nowadays in many large cities; the high monthly costs associated with registering to become a member of an athletic association and transport costs to and from the association building, a desire to work out in a private environment, the requirement of self-monitoring one's medical condition when the physical exercise is associated with a current medical condition.

There already exists exerciser devices being useful as indoor (not excluding outdoor setting) tools to enable an individual to physically keep in shape. These devices usually include a generally open rigid frame, against which an individual will move relative thereto while being connected thereto usually with the hands or the feet, through various pivotal motions and the like. However, these known exerciser devices have limited versatility, because due to their specific frame layout, the number of different physical exercises that can be performed therewith is relatively small. A number of these exercisers are not completely stable in use, and thus may constitute a safety hazard. Many of these exercisers take up a lot of ground space, which would preclude their use in small appartments where existing furniture take up most of the available space. They are sometimes difficult to move around, in particular if only one person is available. They are often not dismanteable so they cannot be stored in a compact area when not in use; or if they are, they require special tools and/or a lot of time for disassembly.

SUMMARY OF THE INVENTION

The invention consists of an indoor body exerciser for allowing a person to perform push-ups, sit-ups, dips, chin-ups, stretching and the like exercises, using one's own body weight to determine the force of gravity and capacity to do like exercises, said exerciser comprising: a pair of elongated arcuate posts defining upper and lower ends, said lower ends for stable ground engagement, said elongated posts;

a U-shape member, releasably interconnecting both of said upper ends of the elongated posts and extending transversely therefrom, wherein said posts become substantially parallel to each other and wherein a web portion is defined by said U-shape member for abutting engagement against an upright support wall spacedly over ground in an operative position of said exerciser, said U-shape member forming a spacer member between the arcuate posts and the upright support wall to keep said arcuat posts generally parallel to the upright support wall;

an elongated hand-engageable push-up bar; and a pair of elongated first and second insert members, fitting against corresponding said posts and each defining a number of lengthwisely spaced cavities, said push-up bar releasably engaging a selected pair of horizontally aligned said insert member cavities from the two said insert members.

Preferably, said web of said U-shape member includes outturned end portions, and said U-shape member further including a pair of elbowed tubular members, an outer open end of each of said tubular members being engaged by corresponding said outturned end portions of said web, and an inner end portion of each of said tubular members engaging lengthwisely through said upper ends of said arcuate posts.

Preferably also, at least one anti-skid sleeve member is removably fitted around said U-shape member web for frictional engagement with the upright support wall.

The lower ends of each of said arcuate posts could be removably fitted with an anti-skid shoe, for preventing accidental sliding motion of the exerciser over ground during operation thereof.

A pair of handles could be fixedly and releasably attached to said push-up bar, for allowing either said push-up bar or said handles to be grasped, thus helping to prevent wrist strain by providing alternate hand positions on said exerciser.

Preferably, a second pair of first and second insert members is provided, wherein the two said first insert members are mounted coextensively to one another on the same arcuate post, and the two said second insert members are mounted coextensively to one another on the same arcuate post, said push-up exerciser being accordingly of a larger size.

DETAILED DESCRIPTION OF THE EMBODIMENTS

Figure 1:
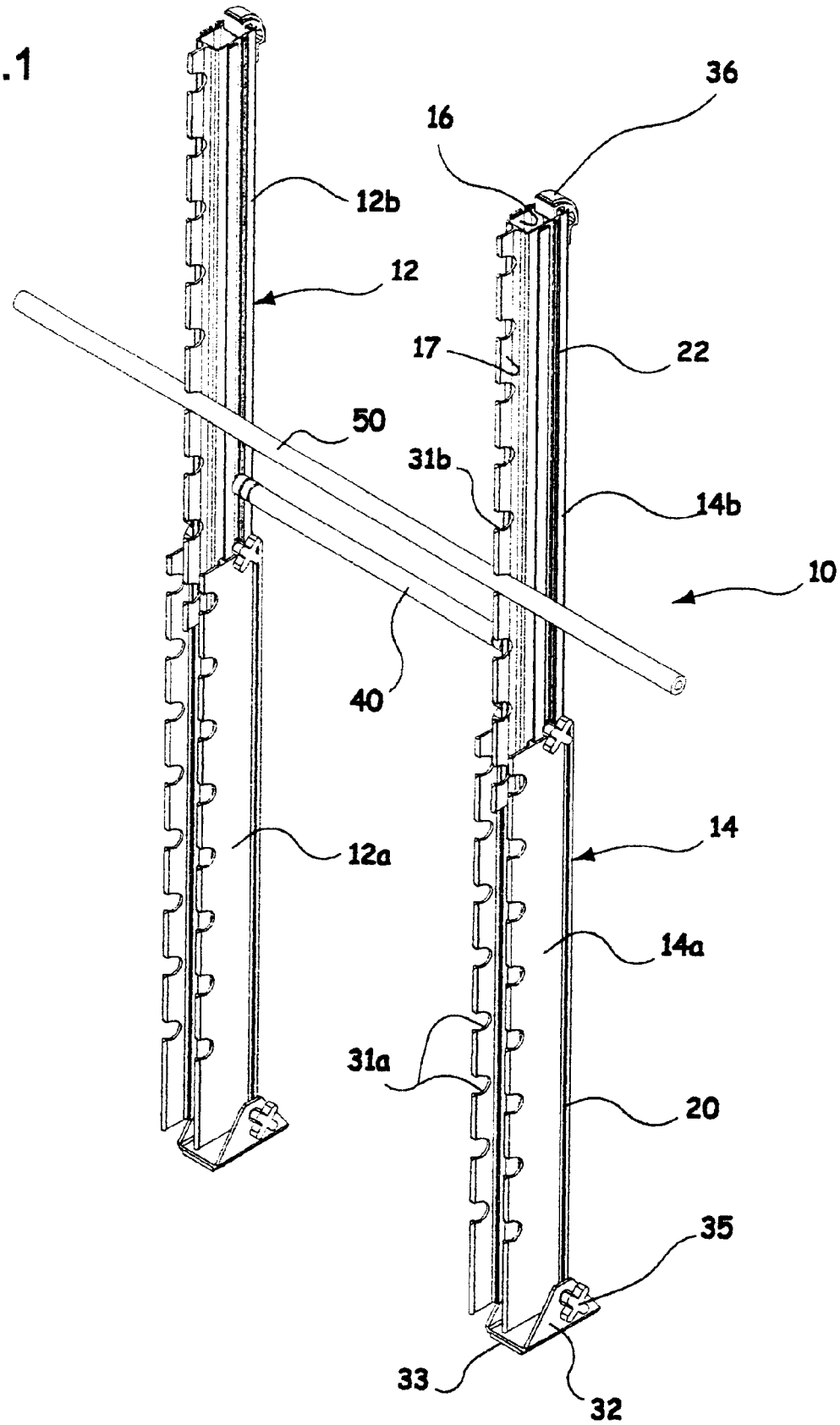
FIG. 1 is a perspective view of a first embodiment of exerciser of the invention.

FIGS. 1–4 show a body exerciser 10 according to the invention, which comprises a pair of elongated, straight support posts 12, 14 each having a lower sleeve portion 12*a*, 14*a* and an upper portion 12*b*, 14*b* telescopingly slidable in their respective sleeve portions 12*a*, 14*a*. Posts 12, 14 are identical, and hereinafter, for clarity of the description, reference will only be made to post 14, although it must be understood that post 12 is included in this description.

The upper portion 14*b* of post 14 has a main body 16 having a generally rectangular cross-section, and a longitudinal frontwardly projecting fin plate 17 is integrally attached on an intermediate portion of the front face of main body 16.

Figure 3:
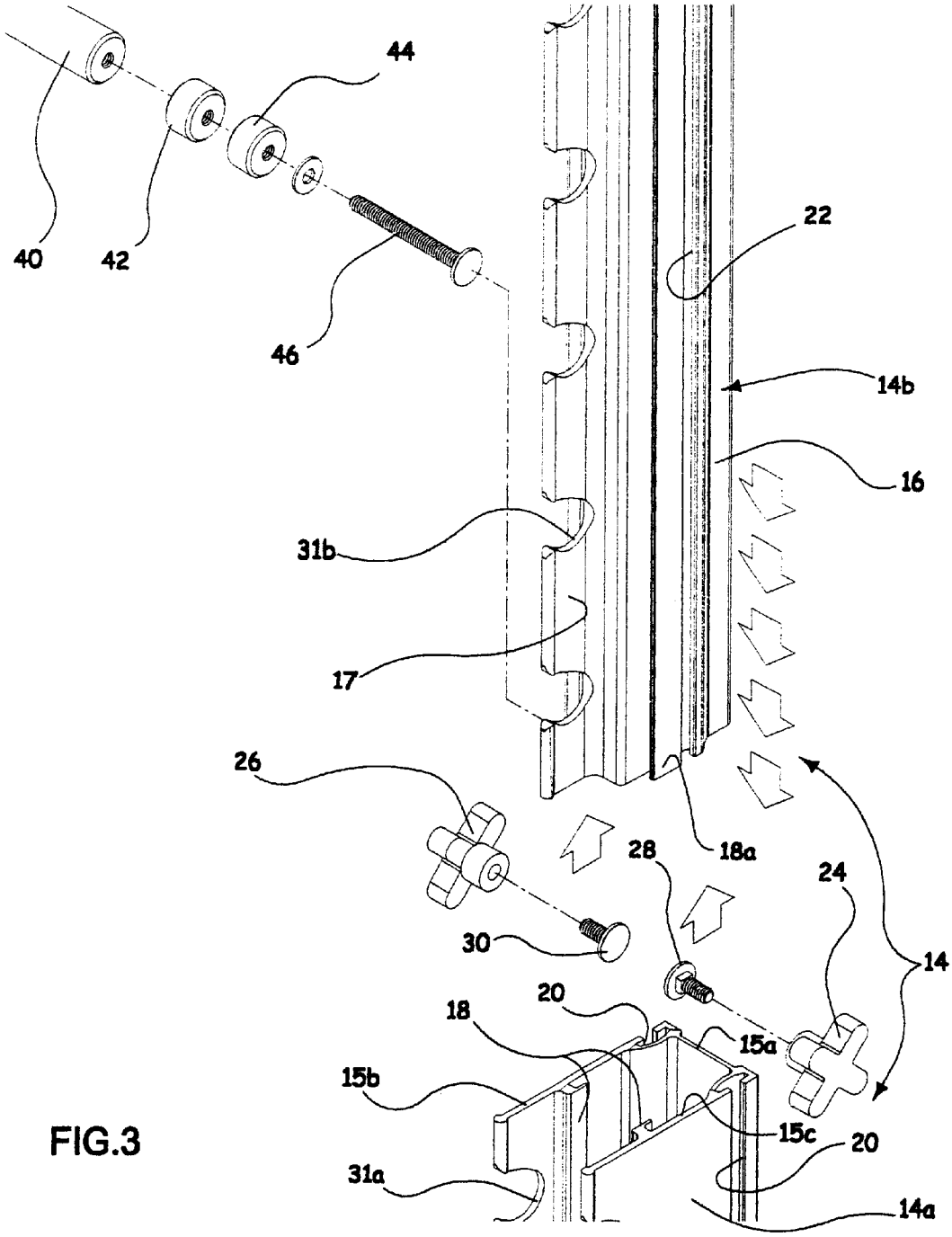
FIG. 3 is an enlarged perspective view of area III of FIG. 2.

Sleeve portion 14*a* is cross-sectionally U-shaped and, as shown in FIG. 3, defines a web portion 15*a* and two side plates 15*b*, 15*c* to form a frontwardly opened channel, in which is slidable the rectangular main body 16 of upper portion 14*b* which is sized to fit in the channel-shaped sleeve portion 14*a*. Longitudinal flanges 18, inwardly located on an intermediate portion of the side plates 15*b*, 15*c* of the opened sleeve portion 14*a*, partially close the channel-shaped sleeve portion 14*a* to prevent the upper portion 14*b* from being accidentally frontwardly released from their engagement inside sleeve portion 14*a*; the post upper portion 14*b* being provided with lateral longitudinal flanges 18*a* which engage the flanges 18 of sleeve portion 14*a* for this purpose. When the post upper portion 14*b* slides inside sleeve portion 14*a*, the fin plate 17 frontwardly extends between flanges 18, and between and parallel to the sleeve portion side plates 15*b*, 15*c*.

Post 14 is provided with longitudinal tracks, and more particularly sleeve portion 14*a* has symmetrical inner and outer tracks 20, 20 and upper portion 14*b* also has symmetrical inner and outer tracks 22 (with the inner track being concealed in the drawings). The inner and outer tracks 22 of post upper portions 14*b* are engaged by stopper members in the form of screwable knobs 24, 26 engaging bolts 28, 30, the latter being slidable inside track 22 and being rotationally motionless due to their square neck portion snugly sliding in track 22, as known in the art. The position of the knob and bolt assemblies 24, 28 and 26, 30 is manually adjustable by unscrewing knobs 24, 26 to slide them along tracks 22, and thereafter by screwing them to releasably fix their position. Thus, the length of post 14 can be adjusted by sliding upper portion 14*b* down into sleeve 14*a*, until the knobs 24, 26 abut against the upper edges of the side plates 15*b*, 15*c* of sleeve portion 14*a*, with knobs 24, 26 being fixedly installed at a selected position to allow selective adjustment of the length of post 14.

The side plates 15*b*, 15*c* of the post sleeve portion 14*a* are provided with a number of equally-spaced, frontwardly-opened notches 31*a* distributed along their length. Each notch 31*a* on side plate 15*b* is horizontally aligned with a corresponding notch 31*a* on side plate 15*c*. The post upper portion 14*b* is also provided with notches 31*b* located on longitudinal fin plate 17, with notches 31*b* also being equally spaced-apart, the spacing between notches 31*b* further preferably being equal to the spacing between notches 31*a*, as shown in the drawings. Also, notches 31*a*, 31*b* are preferably slightly frontwardly upwardly inclined, as illustrated.

Post 14 has a pivotable footrest 32 at its lower end which defines a substantially flat underface, and which is attached to post 14 with a pair of bolt and knob assemblies 34, 35 such as the ones 24, 28 and 26, 30 described hereinabove. This allows footrest 32 to be pivoted into a desired angular position relative to post 14, and then fixed in this position, or alternately to freely pivotally engage the tracks 20 of post 14 if the knob 35 is not tightened, so as to allow post 14 to be freely pivotable about footrest 32 when it rests on the ground. Preferably, the footrest underface is provided with a friction pad 33, to prevent accidental slipping of footrest 32 on the ground.

Figure 4:
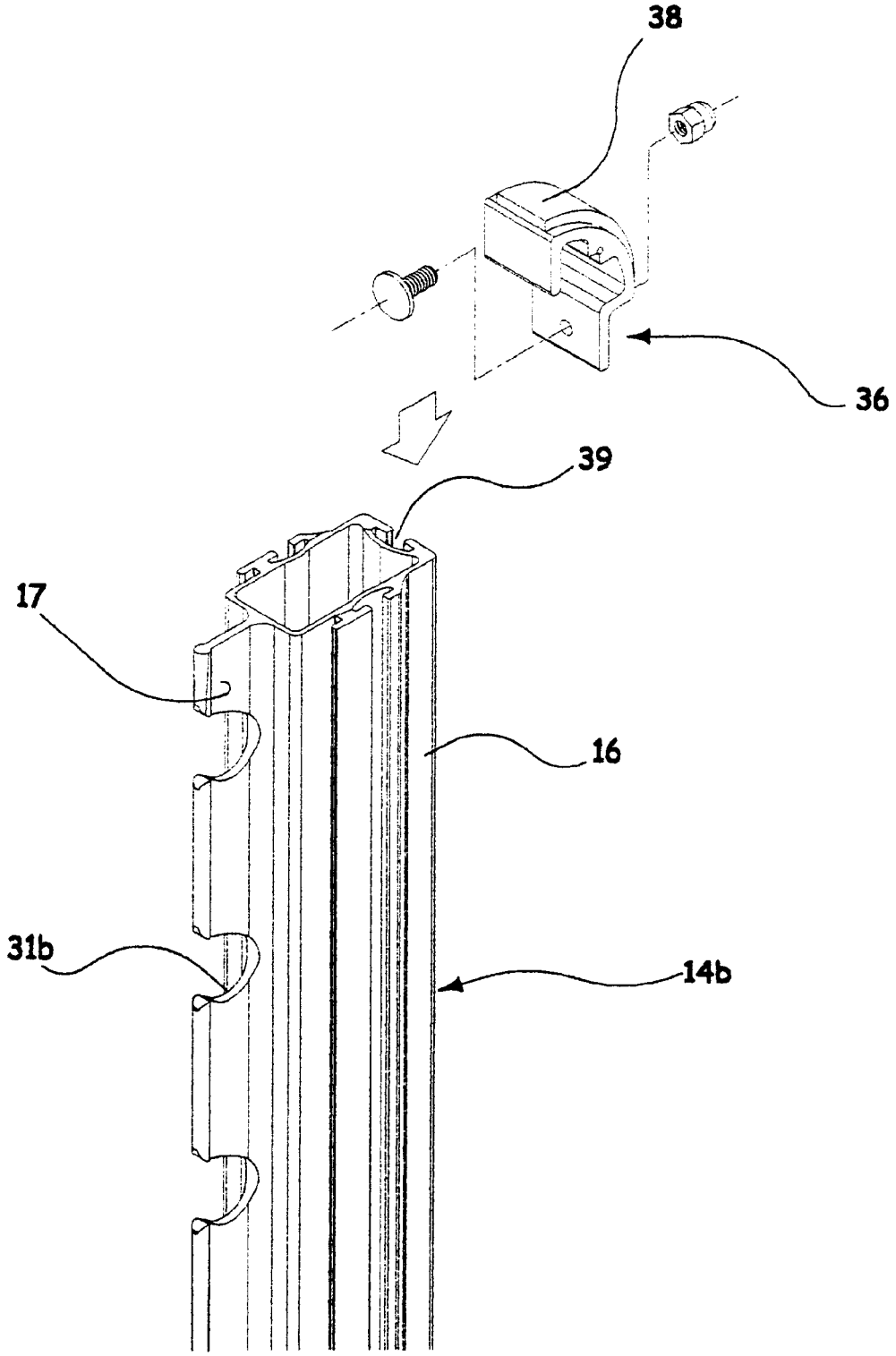
FIG. 4 is an enlarged perspective view of area IV of FIG. 2.

Post 14 further has an upper shoulder member 36 at its upper end which is fixedly attached at the upper extremity of the post upper portion 14*b*. Shoulder member 36 has an arcuate outwardly-facing abutment surface 38, as suggested in FIG. 4, and engages a longitudinal rear track 39 located rearwardly of the post upper portion 14*b* (FIG. 4).

Figure 2:
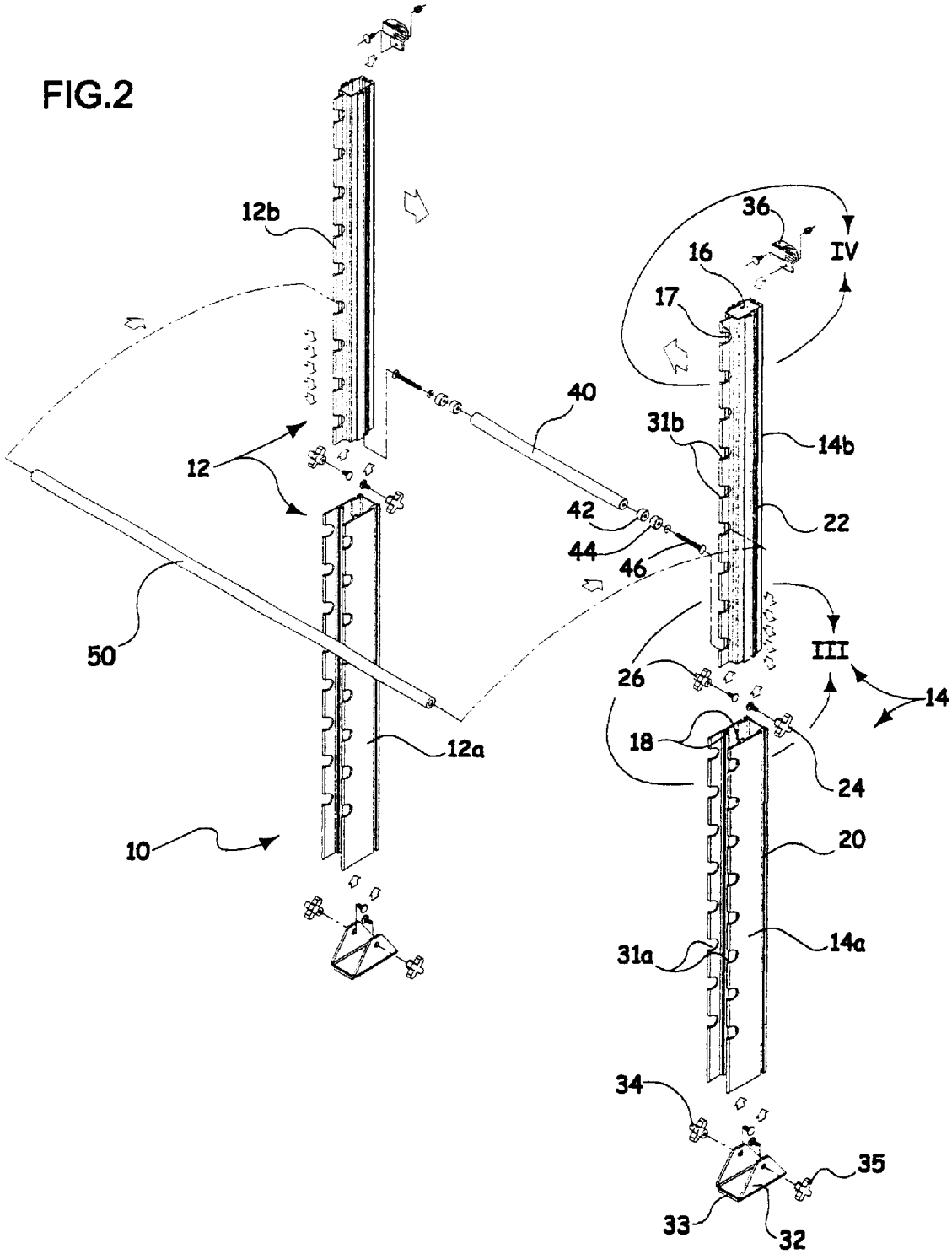
FIG. 2 is a exploded perspective view of the exerciser of FIG. 1.

A spacer bar 40 links posts 12, 14 to each other, to prevent one post from accidentally sliding away from the other. The use of spacer bar 40 is not compulsory, and it is envisioned that a simpler embodiment of the invention be provided where the spacer bar 40 would not be present. As shown in FIGS. 2 and 3, spacer bar 40 is engaged at one bored and threaded extremity by a square-necked bolt 46 which in turn engages the inner track 20 of post 14, with a pair of threaded rings 42, 44 allowing the spacer bar to be tightened between the posts 12, 14 by screwing ring 42 along bolt 46 and against bar 40, and ring 44 along bolt 46 and against post 14. Spacer bar 40 is similarly attached to post 12 at its opposite extremity.

Figure 5:
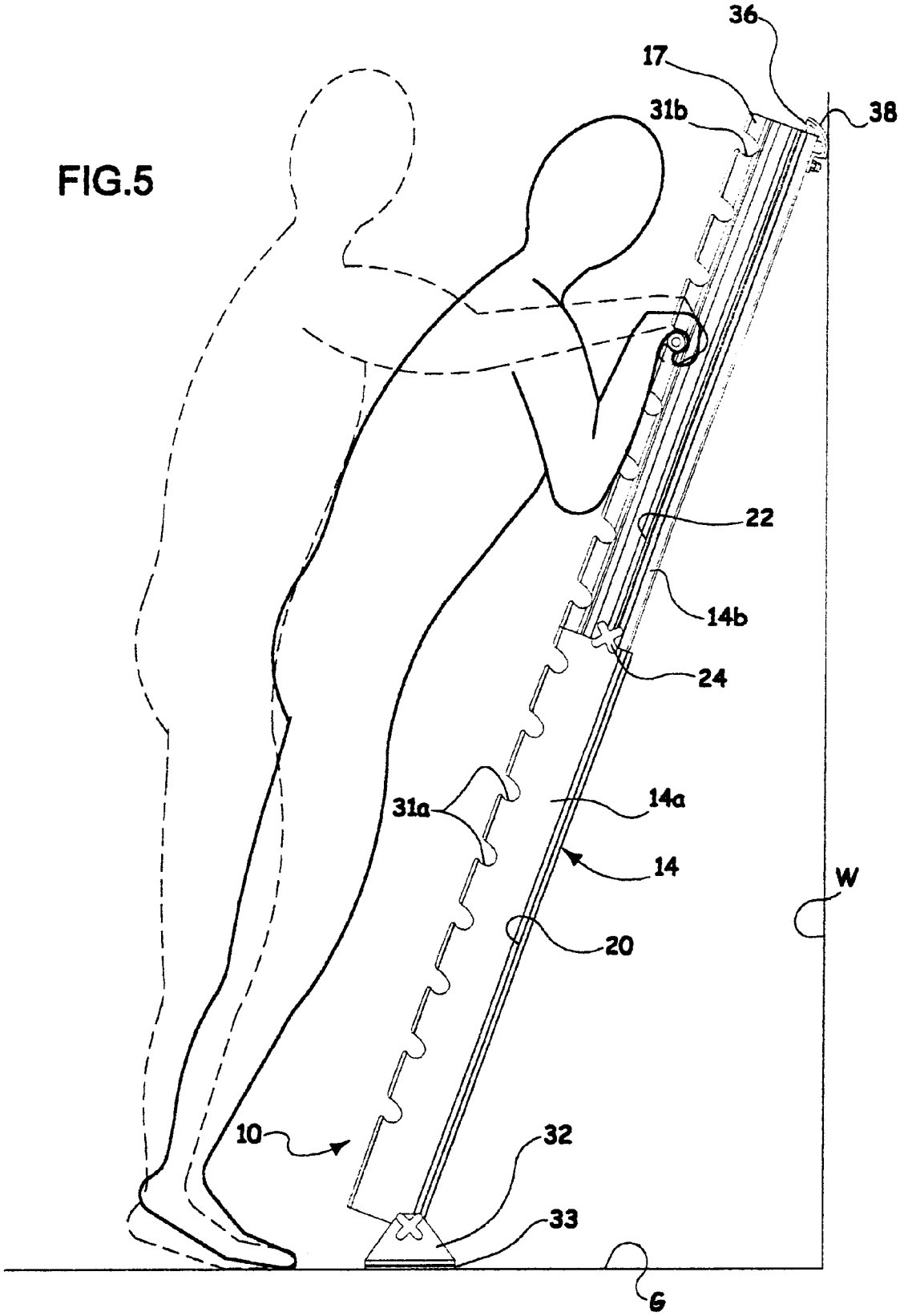
FIG. 5 is a side elevation of the first embodiment of exerciser of the invention operatively resting against a wall, with a person being schematically shown in full lines and in dotted lines in two push-up positions respectively.

A push-up bar 50 is installed so as to bridge the posts 12 and 14 in a manner described hereinafter. In use, as shown in FIG. 5, posts 12, 14 are to vertically rest on the ground G with footrests 32, and horizontally abut against a wall W with shoulders 36. Thus, posts 12, 14 are substantially parallel to each other and inclined in an operative position of exerciser 10. Push-up bar 50 is inserted into and rests on selected horizontally aligned notches 31*b* and/or 31*a* of posts 12, 14, so as to support push-up bar 50 over ground. Push-up bar 50 can be manually gripped, as shown in FIG. 5, to perform push-ups. By selecting different notches 31*a*, 31*b* to be engaged by push-up bar 50, the vertical height of bar 50 can be selected to adjust the degree of difficulty in performing the push-ups.

If push-up bar 50 is positioned at the level of the posts sleeve portions 12*a*, 14*a*, then the posts upper portions 12*b*, 14*b* have to be positioned either:

a) so as to horizontally align the notches 31*a* and 31*b* respectively of the posts lower sleeve portions 12*a*, 14*a* and upper portions 12*b*, 14*b*, fin plates 17 then being located in an unobstructive position between side plates 15*b*, 15*c* of the sleeve portions 12*a*, 14*a* since push-up bar may then engage both the notches 31*a* and 31*b* on each post 12, 14; or b) so as to vertically upwardly clear the notches 31*a* of the posts sleeve portions 12*a*, 14*a*, fin plates 17 then being located in an unobstructive position over the engaged notches 31*a*.

One particular advantage brought about by the present invention is that little floor area is required by the mostly vertical push-up exerciser 10. Indeed, since the push-up exerciser 10 rests against the wall, it takes up little space when compared to prior art self-standing exercisers which rest on the ground often by means of a ground-engaging plate or several spaced-apart feet which take up a relatively large floor area for maintaining a suitable stability. Furthermore, the push-up bar 50 of the exerciser 10 of the present invention can be installed high over ground, e.g. at shoulder height as shown in FIG. 5, without compromising the stability of exerciser 10 as could be the case with prior art self-standing exercisers, and without taking up more floor space. Thus, exerciser 10 can be used with the push-up bar 50 located high over ground, for example for persons with physical indispositions who would not be able to accomplish push-ups with the push-up bar located at a lower position, or for persons simply desiring to perform push-ups with a higher positioned push-up bar.

Another advantage of the exerciser 10 of the present invention is that it may be easily disassembled to be stored, especially with an embodiment of the invention where the spacer bar 40 is not used. Indeed, the push-up bar 50 has simply to be retrieved from their supporting notches 31*a* and/or 31*b*, and the support posts 12, 14 and the push-up bar 50 may then be stored directly. The length of the support posts 12, 14 can be shortened before they are carried or stored. Thus, only several straight elements, namely the two support posts 12, 14 and the push-up bar 50, possibly together with the spacer bar 40 if the latter is used, can be handled by a single person to be carried and stored in an uncumbersome fashion when exerciser 10 is in a disassembled condition.

Figure 6:
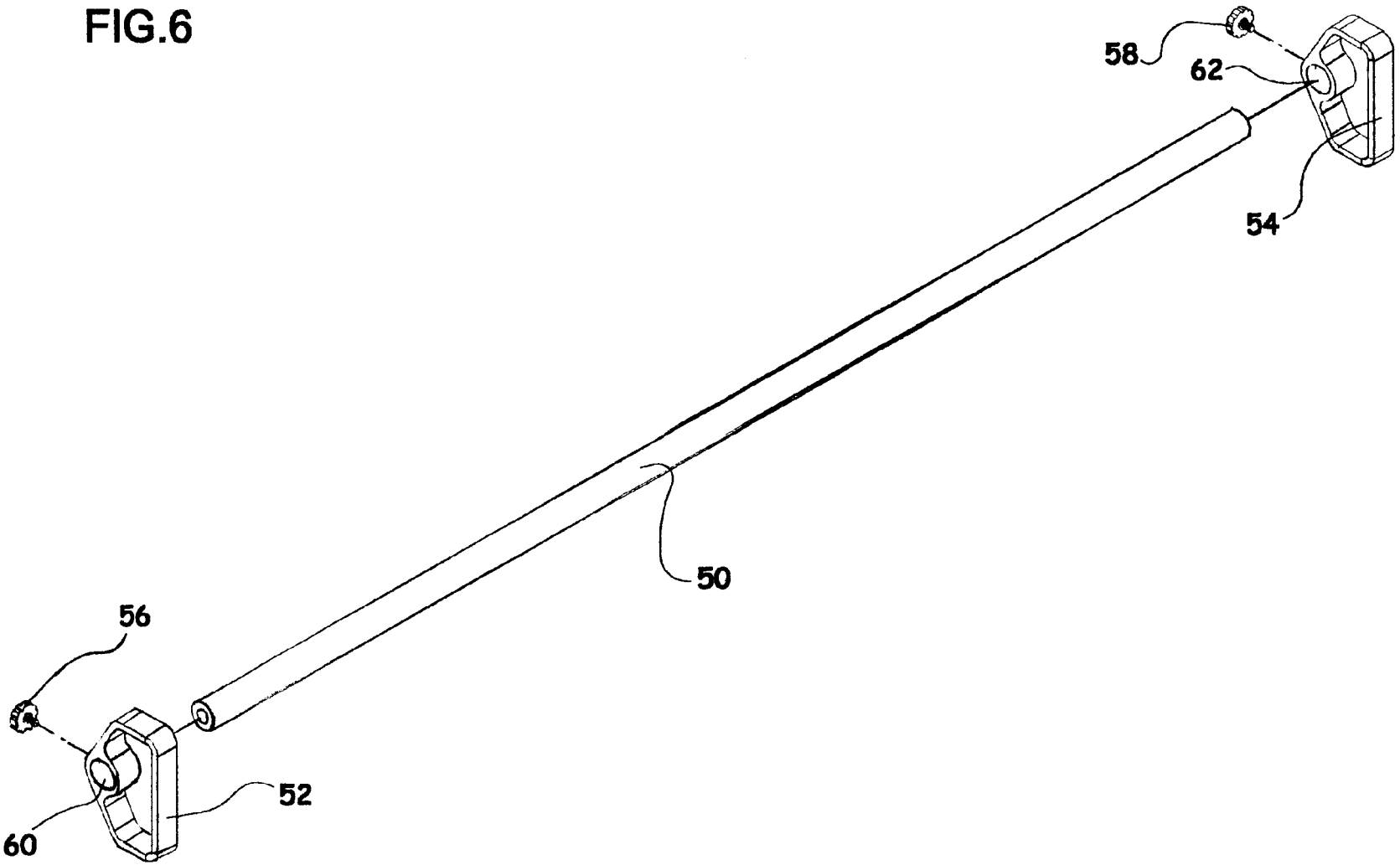
FIG. 6 is an exploded perspective view of an alternate embodiment of the push-up bar of the first embodiment of exerciser of the invention.

FIG. 6 shows that the push-up bar 50 may be provided with a pair of handles 52, 54 selectively positioned along bar 50, e.g. at each extremity. Set screws 56, 58 releasably fix handles 52, 54 at their selected positions on bar 50, with handles 52, 54 having a rear sleeve portion 60, 62 for sliding engagement along push-up bar 50. Handles 52, 54 allow the person using exerciser 10 to perform push-ups with different hand positions, i.e. either grasping push-up bar 50 or handles 52, 54. These different hand positions help reduce wrist strain.

Figure 7:
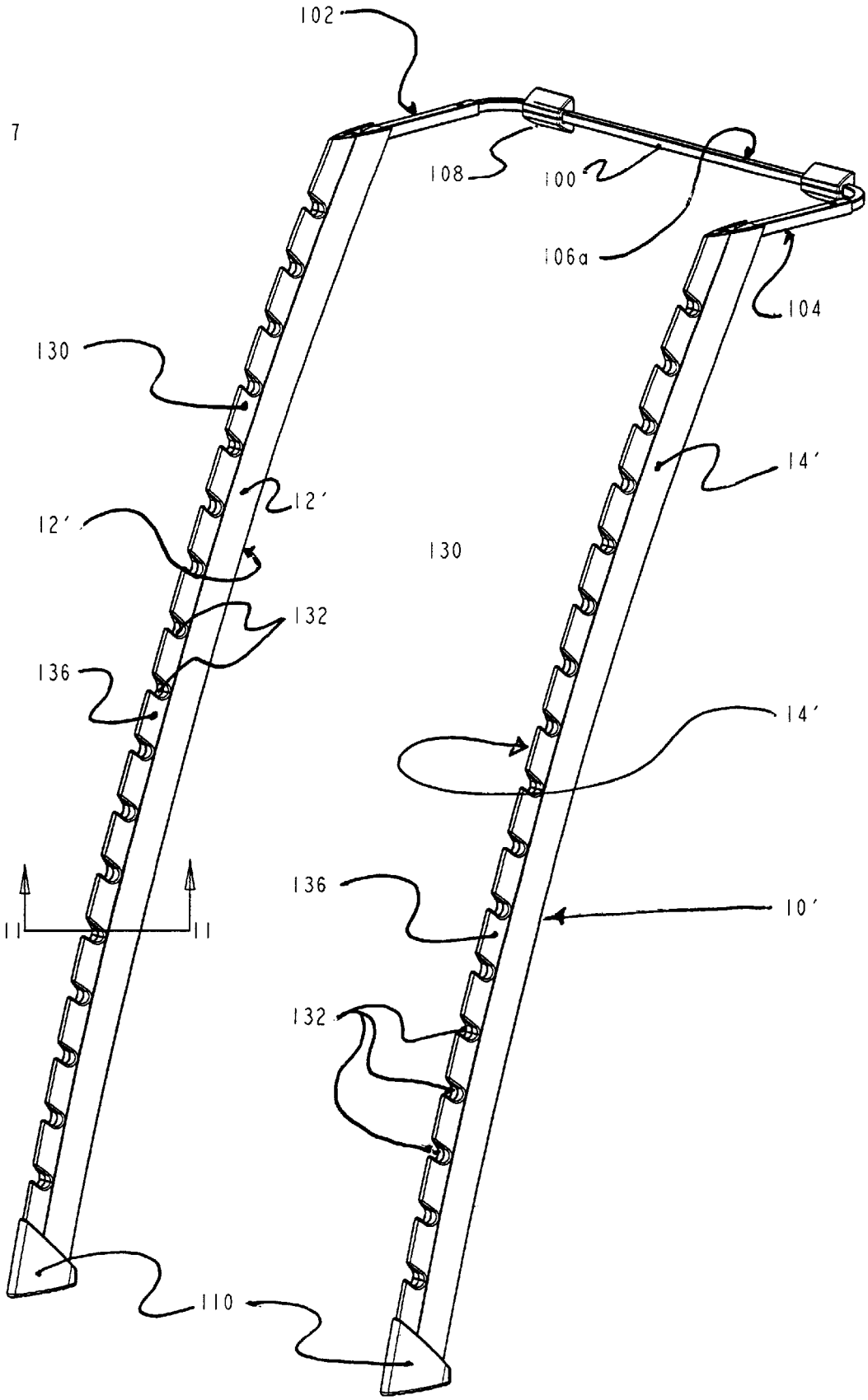
FIG. 7 is a perspective view of a second preferred embodiment of exerciser of the invention, in upright condition.
Figure 8:
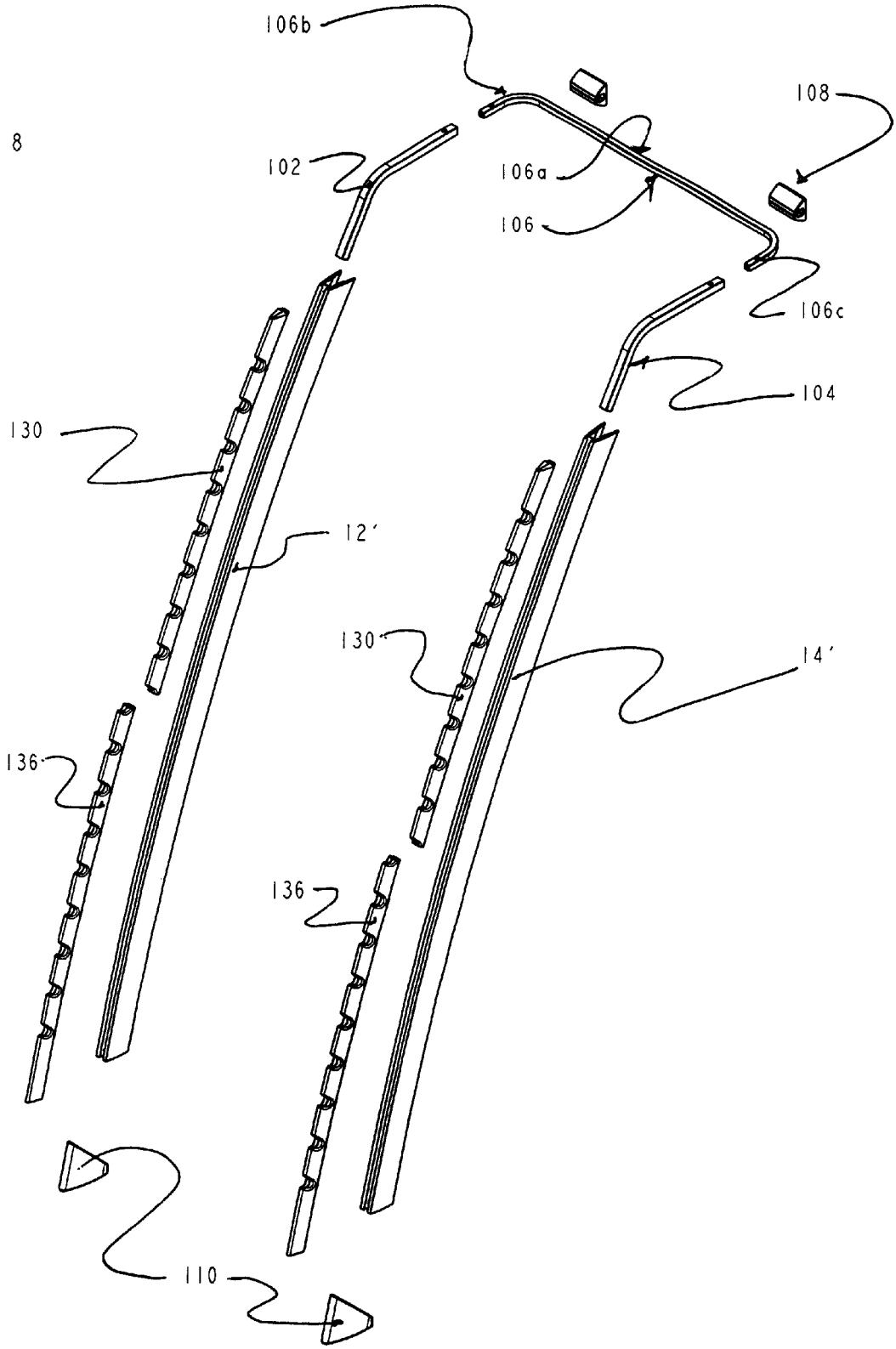
FIG. 8 is an exploded view of the exerciser of FIG. 7.
Figure 9:
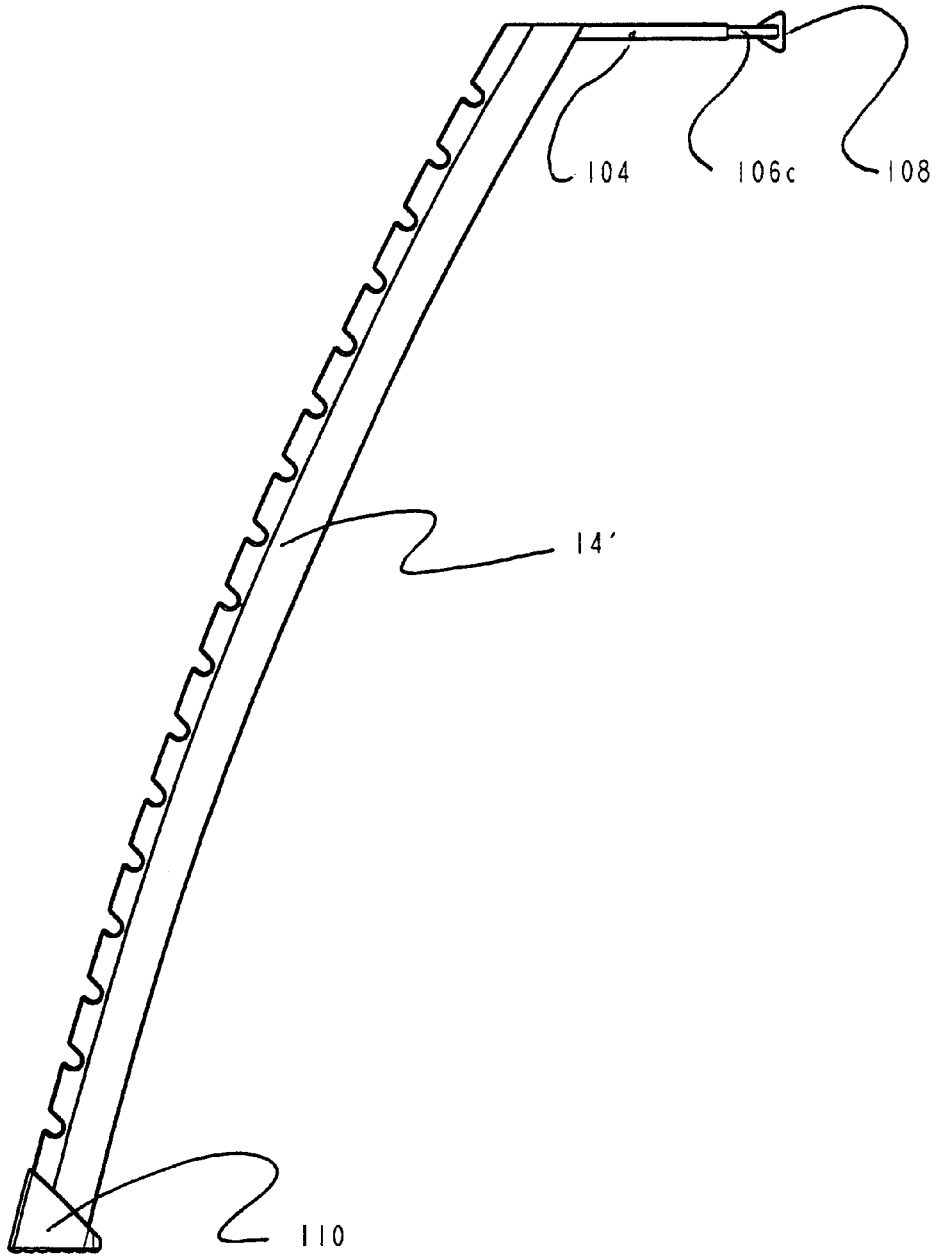
FIGS. 9 and 10 are a side elevation view and a front elevation view, respectively, of the exerciser of FIG. 7.
Figure 10:
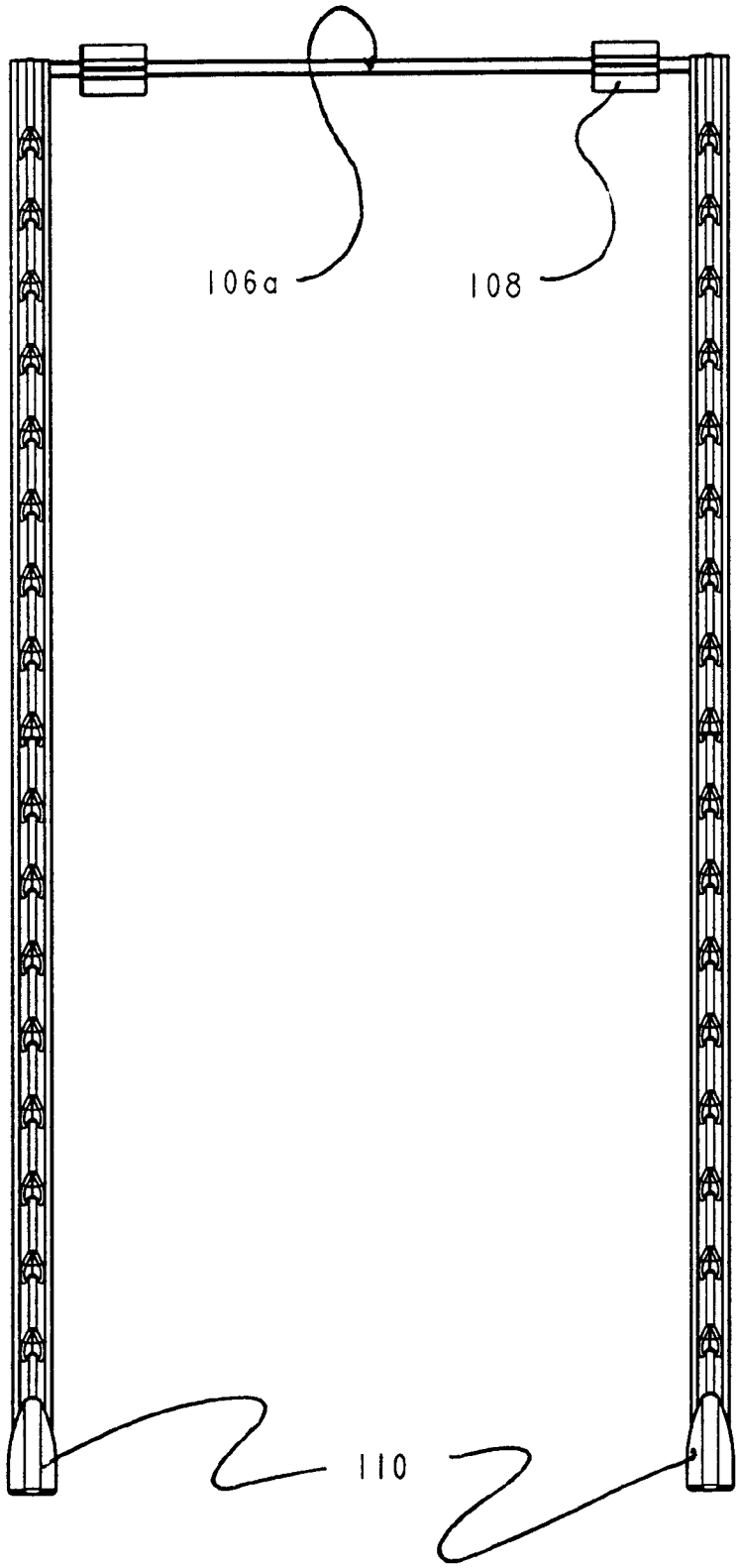

In the alternate but preferred embodiment of exerciser shown in FIGS. 7–8 of the drawings, corresponding elements are primed. In exerciser 10', the two lateral posts or studs 12', 14', are upwardly rearwardly arcuate, rather than straight as in the first embodiment of FIG. 1, and their top ends are interconnected by a transverse U-shape member 100. This U-shape member 100 includes a pair of elbowed hollow tubular members 102, 104, each endwisely engaged at their bottom ends into the recess of the top end of a corresponding one of the main studs 12', 14'. U-shape member 100 also includes a U-shape bar 106 having an elongated web 106*a* and two very short side legs 106*b*, 106*c*, with legs 106*b*, 106*c*, sized for and endwisely engaging into the hollow of the top ends of the corresponding tubular members 102, 104. Legs 106*b*, 106*c*, are fixedly but releasably anchored in place into tubes 102, 104, by suitable means, e.g. through friction fit engagement or preferably and as suggested in FIG. 8 by pins engaging registering bores therein.

Figure 17:
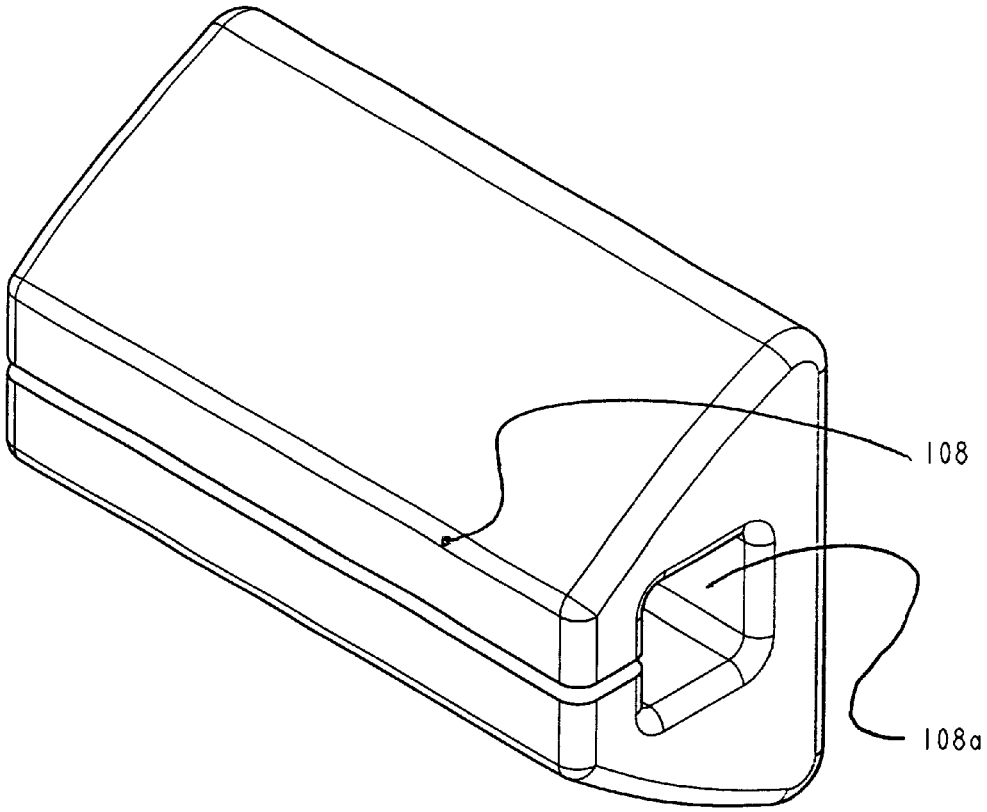
FIGS. 17 and 18 are a perspective view and a cross-sectional view respectively of one of the anti-skid abutment sleeves mounted at the top end of the exerciser of FIG. 7.
Figure 18:
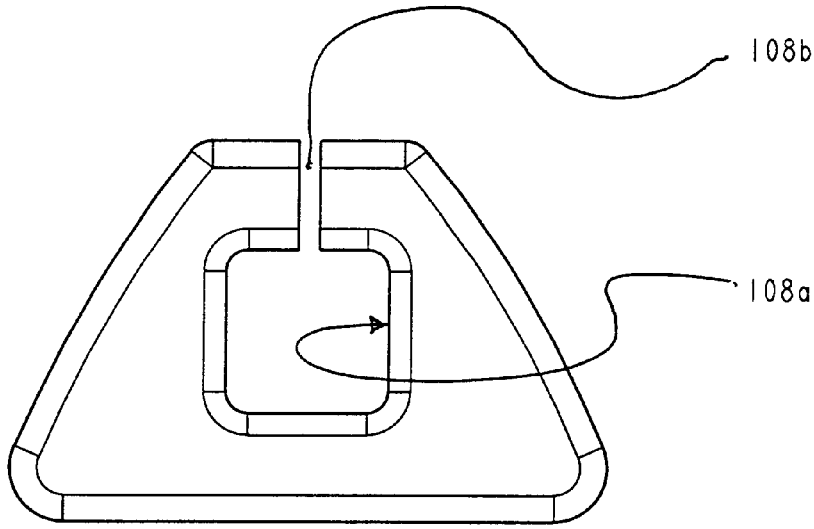

Preferably, at least one, and preferably a pair of spaced anti-skid sleeve members 108, (FIGS. 17–18) are releasably secured to web 106*a*, for frictional engagement with a supporting dwelling wall. Sleeves 108 may be for example made of elastomeric material. Each sleeve member 108 is generally triangular in cross-section, with a tubular axial through-bore 108*a* sized for frictional axial engagement by the web 106*a*. Preferably, the sleeve member 108 is slitted at its apex, 108*b*, for alternately enabling transverse deforming engagement of the sleeve 108 onto the web 106*a*, rather than endwise engagement thereof onto the U-member side legs 106*b*, 106*c* (which then requires sliding displacement of the sleeve 108 to its selected position on the web 106*a*).

Figure 15:
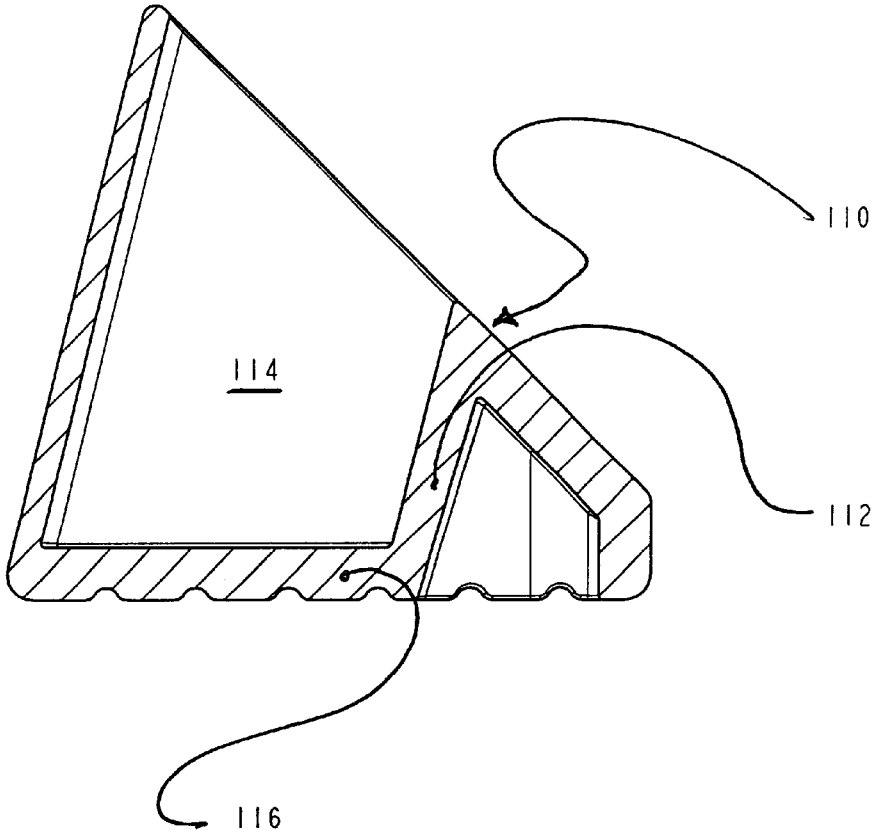
FIGS. 15 and 16 are an cross-sectional view and bottom plan view respectively of the anti-skid shoe mounted at the bottom end of each main frame stud of FIG. 7.
Figure 16:
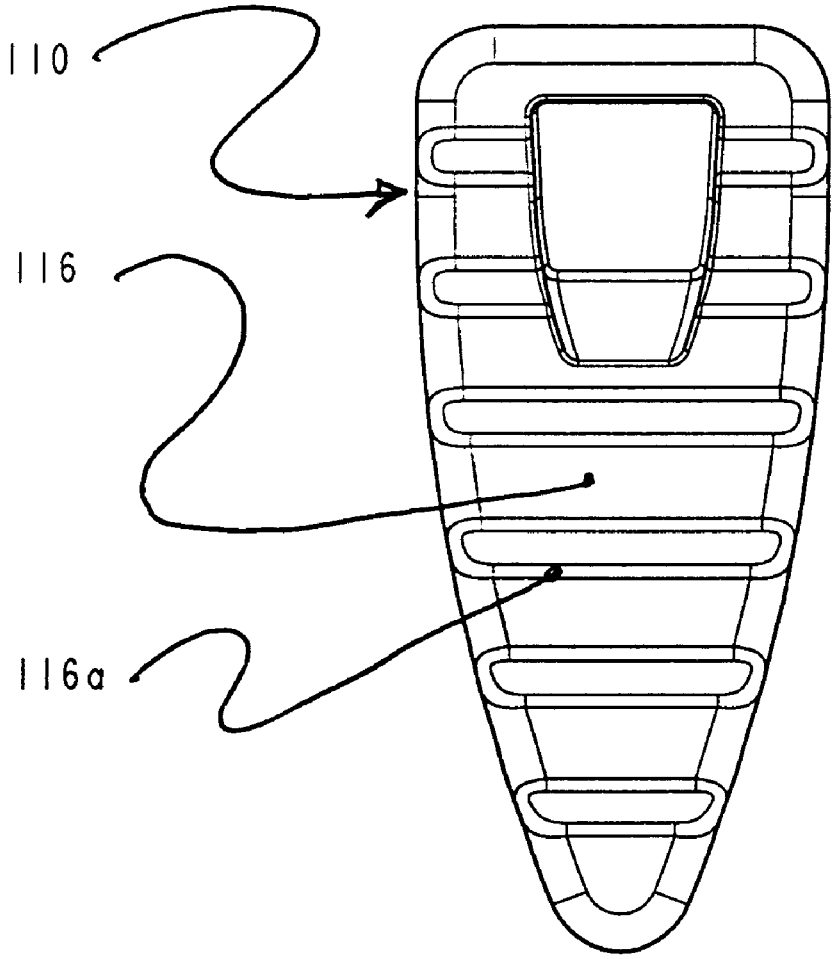

Preferably, and as illustrated in FIGS. 8 and 15–16, the bottom ends of each main stud 12', 14', is releasably engaged by an anti-skid shoe 110. Each shoe 110 includes a rigid open frame 112 with a cavity 114 sized to snugly receive the bottom end of a main stud 12' or 14', and a flat underface 116 having a knurled surface 116*a*. Cavity 114 is slanted, to follow the arcuate contour of the exerciser.

Figure 11:
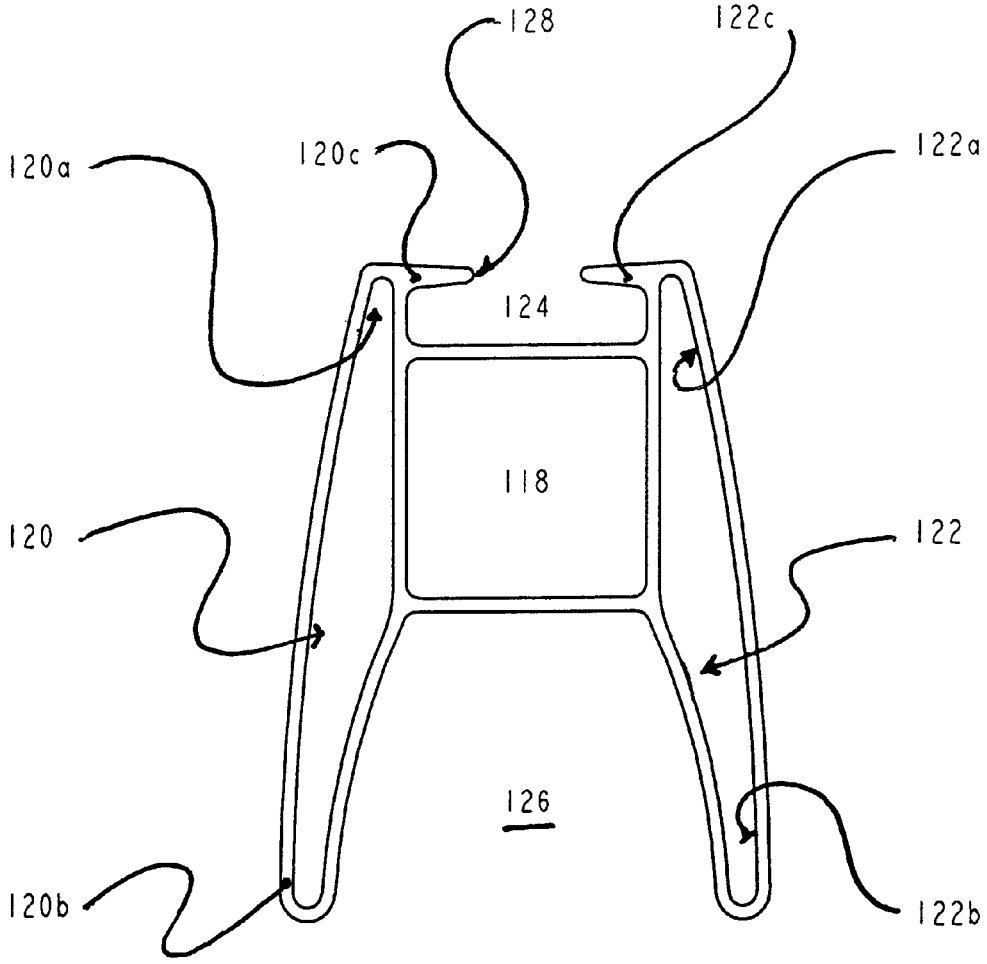
FIG. 11 is an enlarged cross-sectional view of one main elongated frame stud from the exerciser of FIG. 7.

A main stud 12' (stud 14' would be similar) of the second embodiment of exerciser is shown in cross-section in FIG. 11 of the drawings. Stud 12' includes a core tubular section 118 of quadrangular (preferably square) cross-section, flanked on both opposite lateral sides by a hollow tubular wing 120, 122. Each wing 120, 122, projects beyond the core section 118 at both the fore and aft ends thereof, thus forming a first fore cavity 124 bounded by fore flanges 120*a*, 122*a*, and a second aft cavity 126 bounded by aft flanges 120*b*, 122*b*, with flanges 120*a*, 120*b*, 122*a*, 122*b*, being integral to the wings 120, 122, respectively. Aft flanges 120*b*, 122*b*, are arcuate and larger relative to fore flanges 120*a*, 122*a*. Fore flanges 120*a*, 122*a*, each include a transverse inturned lip 120*c*, 122*c*, directed toward one another, so that access to the fore cavity 124 be through a narrowed mouth 128 formed between lips 120*c*, 122*c*.

As suggested in FIG. 8, the larger aft cavity 126 is for axially receiving at its top end the lower ends of the elbowed U-member bars 106*b*, 106*c*.

Figure 12:
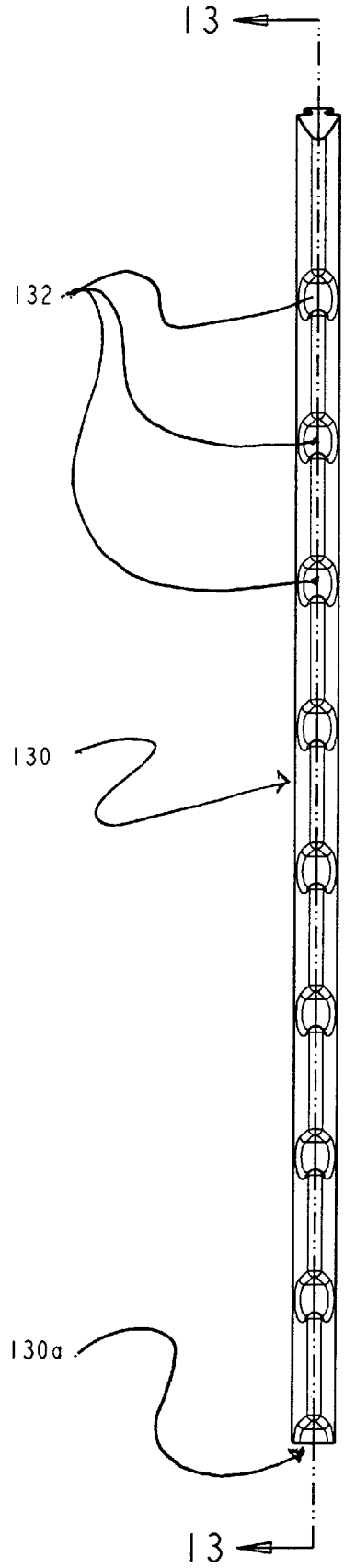
FIGS. 12 and 13 are front and sectional views respectively of a first embodiment of elongated multiple notch cover support for the elongated studs of exerciser of FIG. 7.
Figure 13:
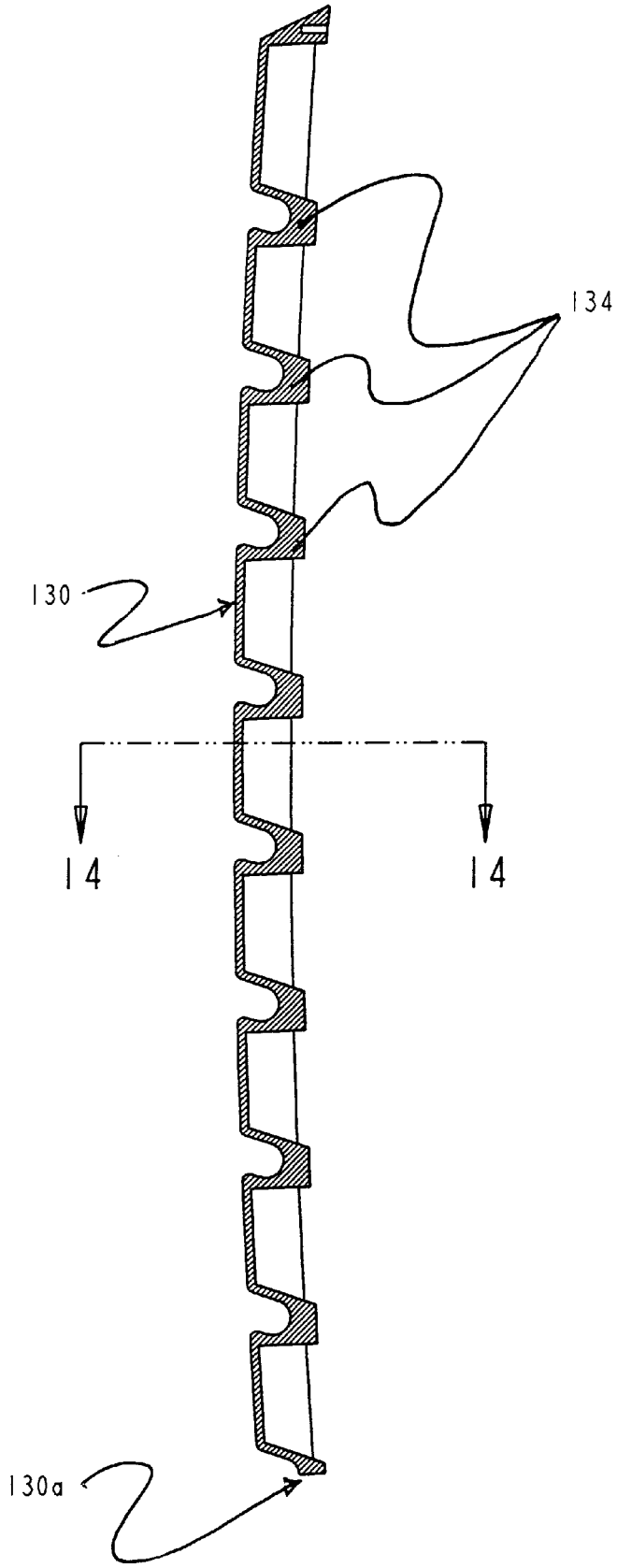
Figure 14:
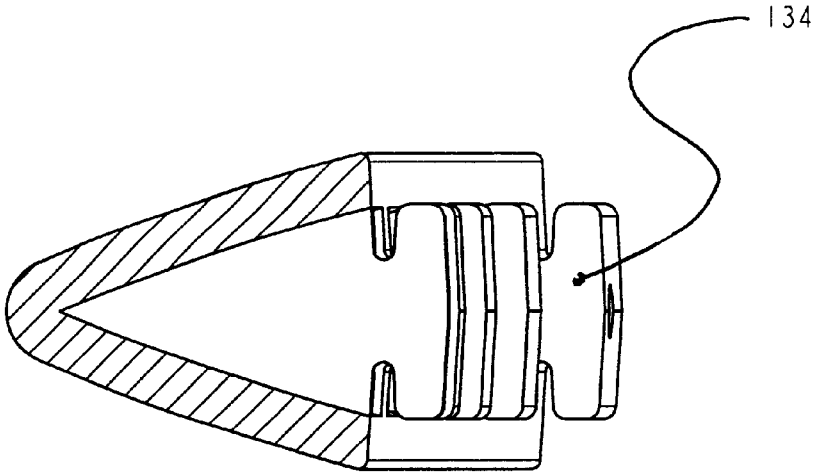
FIG. 14 is a cross-sectional view taken along line 14—14 of FIG. 13.

An elongated tubular insert 130, shown in FIGS. 12–14, is provided to fit against the upper portion of the fore edge of each of the exerciser main studs 12', 14'. Each insert 130 includes a plurality of lengthwisely spaced fore exposed notches 132, for releasably receiving a pole 50'. These notches 132 are upwardly forwardly inclined, and each notch 132 from a first tubular insert 130 comes in horizontal register with a corresponding notch 132 from the second tubular insert 130, so that these latter pair of notches be able to transversely receive, support and retain in horizontal fashion a pole 50'. Furthermore, and as suggested in FIG. 14, a discontinuous rail 134 is formed at the aft side of the tubular insert 130, this rail 134 for sliding engagement through the narrow mouth fore cavity 124 of a corresponding main stud 12' or 14'.

Figure 12A:
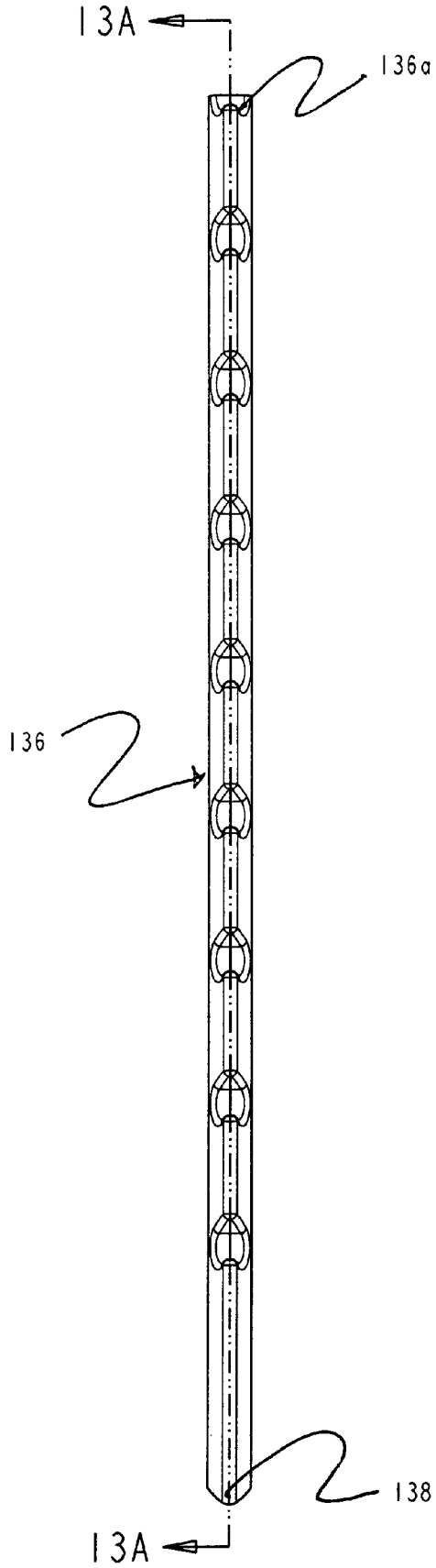
FIGS. 12A, 13A, and 14A, are views similar to FIGS. 12, 13 and 14, respectively, but for a second embodiment of multiple notch cover support.
Figure 13A:
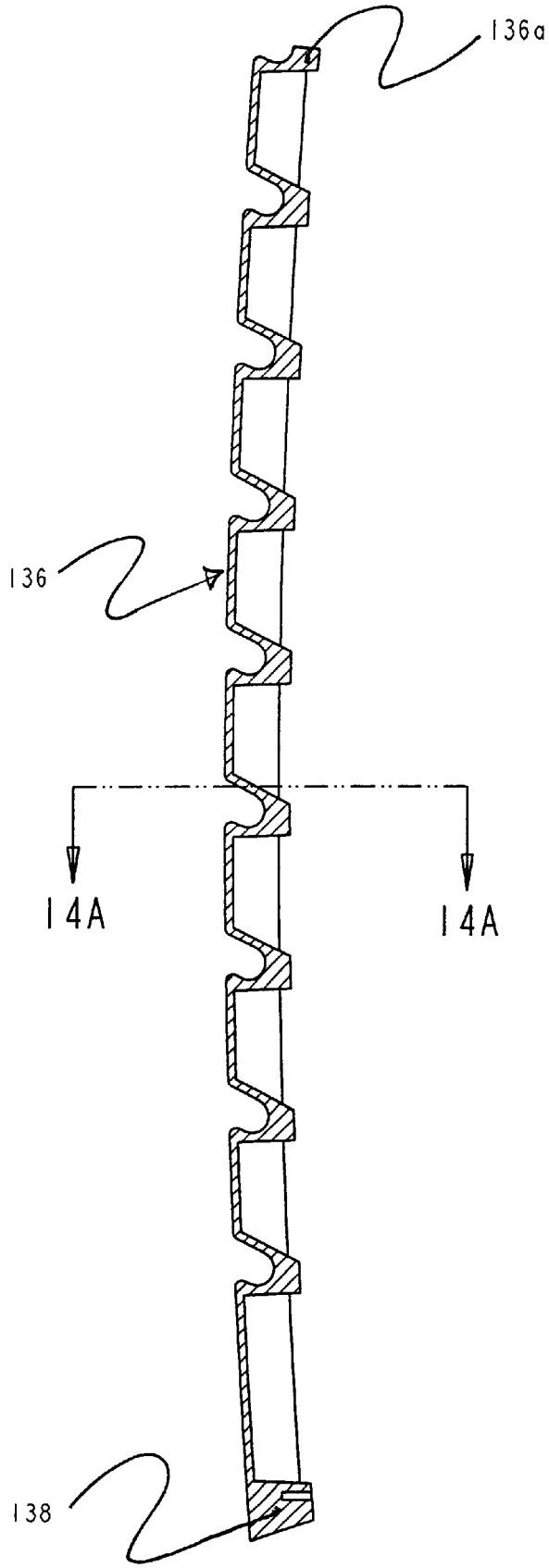
Figure 14A:
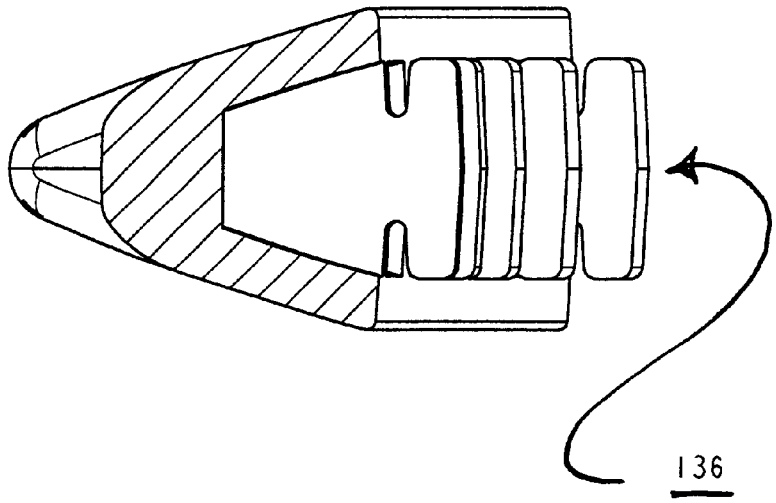

A second elongated tubular insert 136, shown in FIGS. 12A, 13A, 14A, is further provided against the lower portion of the same fore edge of each of the exerciser main studs 12', 14'. Tubular inserts 130 and 136 are similar to one another, except that the top end of each second insert 136 is complementary to the bottom end of a corresponding first insert 130, so that both inserts 130, 136, can be used co-extensively against the exerciser main studs 12', 14'; and the bottom end of second insert 136 forms a foot 138 sized for fitting snugly inside the slanted cavity 114 of the anti-skid shoe 110.

With such an exerciser device 10', a great deal of versatility is achieved, since there is a large number of different types of physical exercises that can be performed therewith. An individual can work out (with push-ups, sit-ups, etc. . . ) either in front of the exerciser 10', or rearwardly thereof between the exerciser and the upright wall onto which abuts the U-member 100, by hand grasping the pole 50' and positioning this pole 50' into a pair of notches 132, 132, from the pair of main studs 12', 14'. The exerciser 10' is very stable and sturdy, and thus much safer in use than the prior art devices. It requires only minimal ground space, yet provides optimum convenience and performance. It is easily displaceable over ground level, is lightweight and easy to use. When not in use, it can be readily and quickly dismantled by unskilled labour, to store the exerciser 10' is a compact storage area.

It is understood that any other modifications which have not been disclosed herein but which do not deviate from the scope of the present invention, are considered to be included herein.

For example, it is envisioned in the first exerciser embodiment 10, that the push-up bar supporting notches 31*a*, 31*b* be replaced by outwardly projecting studs, for supporting the push-up bar, or any other suitable load-bearing support. Also, the upper shoulder rests could be in the form of a rounded upper portion of the support posts 12, 14, instead of distinct elements 36 attached to posts 12, 14. Generally, any suitable surface adapted for horizontal abutment against a wall would be acceptable as shoulder rests.

Examples of the versatility of the present exerciser devices include the following physical body work-up exercises:

1) PUSH-UPS standing facing the wall and exerciser grip the bar with palms facing down or up or vertical with the use of handles

2) CHIN-UPS standing behind the exerciser with back facing the wall grip the bar with palms facing down or vertical with the use of handles exercise can be done while in a sitting or kneeling or lying down position as well the wide-grip rear pull-up exercise using body weight develops muscular strength and endurance in the following muscle groups:

Lattisimus dorsi
Teres major
Rhomboids
Serratus anterior
Anterior deltoid (Front) (secondary muscle)
Medial deltoid (Middle) (secondary muscle)
Posterior deltoid (Rear) (secondary muscle)
Biceps (secondary muscles)
Forearms (secondary muscles)

1. Grip a pull-up bar with the hands slightly wider than shoulder width in an underhand or overhand grip and hang the body towards the floor.
2. Lift (pull upward) the entire body while bending the neck downward until the bar is even with the back of the neck (concentric contraction)
3. After achieving a full concentric contraction, lower the body slowly to the original starting position (eccentric contraction)
4. Continue the movement until the desired number of repetitions is achieved.

3) POSTERIOR THIGH AND BUTTOCKS laying down on back facing exerciser with both feet on bar leaving shoulders, head and arms flat on floor, raise buttocks upwards while applying pressure with your feet alternate exercice by extending one leg at a time

4) DIPS standing in front of exerciser with back facing the wall move arms back and to the side and grip the bars with knuckles facing forward and palms facing down

5) REHABILITATION CHIN-UPS place wheelchair behind exerciser with back facing wall grip bar from above with palms facing forward or backward

6) ABDOMINAL CRUNCHES SIT-UPS

The floor abdominal crunch exercise develops muscular strength and endurance in the following muscles:

External obliques
Internal obliques
Rectus abdominus
Transverse abdominus
Intercostals 1. Lie flat on the floor or exercise mat in a supine (on the back) position in front of exerciser. Place the feet on the bar and the knees bent at a 45-degree angle.
2. Before beginning this movement, establish a neutral pelvic tilt for protection of the lower back. Shifting the hips upward and backwards performs a neutral pelvic tilt, thus pressing the lower back into the floor or exercise mat. This position should be held for the duration of each specific abdominal exercise.
3. Begin the exercise by placing the hands behind the base of the neck for cervical support.
   Abdominal crunch with added weight
   Begin the exercise by placing a dumbbell or weight plate in the hands, behind the base of the neck for cervical support or on the chest wall.
4. Lift the upper torso off the floor, elevating the shoulder blades 1 to 4 inches above the floor or exercise mat (concentric contraction). Exhale while lifting the upper torso. Failure to exhale may result in dizziness or possible fainting.
5. After achieving a full contraction, slowly lower the upper torso to the original starting position (eccentric contraction).
6. Continue the movement until the desired number of repetitions is achieved.

7) ABDOMINAL CROSS-OVER CRUNCHES

The oblique crossover exercise develops muscular strength and endurance in the Following muscles:

External obliques
Internal obliques
Rectus abdominus
Transverse abdominus
Intercostals 1. Lie flat on the floor, exercise mat in a supine (on the back) position with the knees bent at 45-degree angle. Position one foot on the bar and cross the opposite ankle over the bent knee (thigh area).
2. Before beginning this movement, establish a neutral pelvic tilt for protection of the lower back. Shifting the hips upward and backwards performs a neutral pelvic tilt, thus pressing the lower back into the floor or exercise mat. This position should be held for the duration of each specific abdominal exercise.

3. Support the head by bringing both hands behind the base of the neck. Beginners can stabilize the torso by placing the opposite arm flat on the ground, just to the side of the body.
4. Begin the exercise by lifting the upper torso upwards and across the body, towards the knee that is crossed over the opposite leg (concentric contraction). Elevate the upper body as much as possible while still maintaining a neutral pelvic tilt. Exhale while lifting the upper torso during the concentric contraction.

Failure to exhale may result in dizziness or possible fainting.

5. After achieving a full contraction, slowly lower the upper torso to the original starting position (eccentric contraction).
6. Repeat the exercise movement on both sides of the body.
7. Continue the movement until the desired number of repetitions is achieved.

8) SQUATS

The squat exercise develops muscular strength and endurance in the following muscle groups:
Quadriceps muscles
Hamstrings muscles
Gluteal muscles
Hip muscles (secondary muscles)
Calf muscles (secondary muscles)

1. Stand upright behind exerciser with back facing the wall. Hold the bar with both hands, palms facing down, shoulder width apart.
2. Place the soles of your feet flat on the ground.
   A wide foot stance emphasizes the gluteal muscles and the hamstrings muscles.
   A close foot stance emphasizes the vastus lateralis of the quadriceps.
   A shoulder-width foot stance emphasizes the entire lower body's muscle groups.
3. Begin the exercise by lowering the body towards the floor (eccentric contraction). During the eccentric contraction of the exercise movement:
   The knee joint angle is never greater than 90-degrees.
   The soles of the feet remain flat on the ground. A small piece of wood or rubber may be placed under the heels of the feet to offset heel elevation.
   The pelvic girdle and lower back rotate slightly.
4. Once the knee joint achieves a 90-degree angle, begin lifting the weighted barbell upward (concentric contraction).
5. The legs are fully extended to a 0-degree angle of knee joint extension. Do not lock the knee joint to full extension.
6. Continue the movement in a slow and controlled motion until the desired number of repetitions is achieved.

9) BRIDGES-BUTTUCK
10) POSTERIOR THIGH RAISES LEG SQUATS
11) LEG RAISES
12) CALF RAISES
13) A VARIETY OF STRETCHES USING THE EXERCISER AND THE BAR
14) POSITIONS:
a) standing
b) sitting
c) kneeling
d) lying down

I claim:

1. An indoor body exerciser for allowing a person to perform push-ups, sit-ups and the like exercises, said exerciser comprising:

a pair of arcuate elongated posts defining upper and lower ends, said lower ends for stable ground engagement;

a U-shape member having a web and two opposite outturned end portions, said U-shape member releasably interconnecting both of said upper ends of the elongated posts and extending transversely therefrom, wherein said posts become substantially parallel to each other and wherein a web portion is defined by said U-shape member for abutting engagement against an upright support wall spacedly over ground in an operative position of said exerciser, said U-shape member forming a spacer member between the arcuate posts and the upright support wall to keep said arcuat posts generally parallel to the upright support wall;

an elongated hand-engageable push-up bar; and a pair of elongated first and second insert members, fitting against corresponding said posts and each defining a number of lengthwisely spaced cavities, said push-up bar releasably engaging a selected pair of horizontally aligned said insert member cavities from the two said insert members.

2. An exerciser as defined in claim 1, wherein said U-shape member includes a pair of elbowed tubular members, each of said tubular members being engaged by said outturned end portions of said U-shape member, and engaging lengthwisely through said upper ends of said arcuate posts.

3. An exerciser as defined in claim 1, further including at least one anti-skid sleeve member, removably fitted around said U-shape member web for frictional engagement with the upright support wall.

4. An exerciser as defined in claim 1, with the lower ends of each of said arcuate posts being removably fitted with an anti-skid shoe, for preventing accidental sliding motion of the exerciser over ground during operation thereof.

5. An exerciser as defined in claim 1, further including a pair of handles fixedly and releasably attached to said push-up bar, for allowing either said push-up bar or said handles to be grasped, thus helping to prevent wrist strain by providing alternate hand positions on said exerciser.

6. An exerciser as defined in claim 1, further including a second pair of first and second insert members, wherein the two said first insert members are mounted coextensively to one another on the same arcuate post, and the two said second insert members are mounted coextensively to one another on the same arcuate post.

* * * * *